US006612567B1

(12) United States Patent
Kaya

(10) Patent No.: US 6,612,567 B1
(45) Date of Patent: Sep. 2, 2003

(54) ADJUSTABLE GRIPPING DEVICE FOR ADJUSTABLE SHEET-RECEIVING POCKETS

(75) Inventor: Mehmet Oktay Kaya, Lee, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/178,651

(22) Filed: Jun. 24, 2002

(51) Int. Cl.[7] ..... B65H 29/04

(52) U.S. Cl. ..... 271/206; 271/204; 294/116; 270/52.19

(58) Field of Search ..... 271/204, 206, 271/205, 85; 294/116, 119.1, 103.1; 198/803.9, 803.7; 270/52.19, 52.14

(56) References Cited

U.S. PATENT DOCUMENTS

| | | | | |
|---|---|---|---|---|
| 3,891,202 A | | 6/1975 | Kircher | |
| 3,955,667 A | * | 5/1976 | Muller et al. | 198/803.9 |
| 4,124,203 A | | 11/1978 | Müller | |
| 4,133,521 A | | 1/1979 | Müller | |
| 4,373,710 A | | 2/1983 | Hansen et al. | |
| 4,496,141 A | | 1/1985 | Nayate | |
| 4,723,770 A | | 2/1988 | Seidel et al. | |
| 4,982,944 A | * | 1/1991 | Eberle | 271/204 |
| 4,988,086 A | | 1/1991 | Schlough | |
| 5,024,432 A | | 6/1991 | Thünker et al. | |
| 5,213,318 A | | 5/1993 | Newhall | |
| 5,251,888 A | | 10/1993 | Eugster | |
| 5,440,983 A | * | 8/1995 | Dopke et al. | 101/410 |
| 5,911,416 A | | 6/1999 | Klopfenstein | |
| 6,213,280 B1 | * | 4/2001 | Abbadessa et al. | 198/377.02 |
| 6,311,968 B1 | | 11/2001 | Linder et al. | |

FOREIGN PATENT DOCUMENTS

| | | | | |
|---|---|---|---|---|
| WO | WO 8907571 A1 | * | 8/1989 | B65H/5/24 |

* cited by examiner

*Primary Examiner*—Donald P. Walsh
*Assistant Examiner*—M Kohner
(74) *Attorney, Agent, or Firm*—Laurence A. Greenberg; Werner H. Stemer; Ralph E. Locher

(57) ABSTRACT

An adjustable gripper system for releasably holding at least one sheet against a surface includes a pivotable gripper shaft with a pivot axis and at least one gripper having a gripper body defining a plunger cavity, the gripper body connected to the shaft for pivoting the gripper about the axis, a gripper plunger slidably disposed in the cavity and holding the sheet against the surface, and a cam follower actuated by a cam. The cam follower is connected to the gripper plunger to displace the gripper plunger along the cavity dependent upon a position of the cam. The system can be part of a sheet-collating pocket having a forward wall and a rearward wall pivotally connected thereto and, together, defining an opening for receiving the sheet, which can be part of a sheet-collating machine having the cam, a conveyor, at least one sheet feeding device, and many of the pockets.

24 Claims, 9 Drawing Sheets

ADJUSTABLE GRIPPING DEVICE FOR ADJUSTABLE SHEET-RECEIVING POCKETS

BACKGROUND OF THE INVENTION

1. Field of the Invention

The invention lies in the field of printing presses. The present invention relates generally to a sheet-conveying apparatus, for example, for conveying newspapers, and, more particularly, to a sheet conveying apparatus having collating pockets moving on a track. In particular, the invention relates to an adjustable gripping device for holding folded sheet material sections in such a collating pocket and for separating folded ends of the sections from one another to allow nesting of inserted other sections.

2. Background Information

Sheet-conveying devices, in particular, devices for conveying newspapers, are required to be able to insert or nest or collate various sets of sheets inside one another. Specifically, to create a finished newspaper, a first folded section of the paper, taking the form of a folded sheet section, is opened and at least one second section of the newspaper is inserted between the two sides of the folded sheet section. It is possible that the second section is, itself, a section having third, fourth, or more other sections nested therein in the same manner as the first section. To process such sheets, in particular, newspapers, prior art conveying devices have an angle-shaped pocket that first picks up a first section, opens the first section, and then conveys the opened first section to a delivery station. Prior art systems including pockets include, for example, U.S. Pat. No. 4,133,521 to M üller and U.S. Pat. No. 5,213,318 to Newhall. A delivery unit drops the second section into the opened first section to create a nested paper with two sections. This process can be repeated for many different sections to create an entire newspaper.

There is a difficulty associated with the pocket properly opening the first section to the appropriate opening position. To facilitate proper opening, each section is formed with a lap. In other words, the two ends of the folded sheet section are not even. Typically, in a sheet-processing direction, the forward-most end of the folded sheet section is longer than the rear-most end of the folded sheet section. Thus, if the fold of the sheet section is at the bottom of the pocket, when viewing the ends of the folded sheet section in the pocket from above, the forward lap is higher than the rear lap.

In such a position, the folded sheet section can be opened if the forward, higher lap is secured by a device (applying a physical contact and/or air suction) and the pocket or folded sheet section is moved or tilted to allow gravity (possibly assisted with suction) to let the rear lap fall away from the forward lap. After the rear lap has fallen or is moved away from the forward lap, there exists an opening into which a second section can be inserted. Accordingly, a second section can be inserted into or nested within the first section. This combined section can then be inserted into a further section, and so on, to create a multiply nested set of sheets, typically, forming a common newspaper.

The securing device typically takes the form of a finger-shaped gripper. In the opening process, such a gripper is rotated or lowered onto the forward lap to secure the forward lap, and the forward sheet section, to a front wall of the pocket. Some examples of prior art gripper systems in such pockets include U.S. Pat. No. 4,723,770 to Seidel et al., U.S. Pat. No. 4,988,086 to Schlough, and U.S. Pat. No. 5,024,432 to Thünker et al.

However, lap sizes are neither consistent nor equal. Therefore, there is a need to adjust such grippers in a vertical direction with respect to a pocket so that the forward lap is gripped in the most efficient place. Prior art pocket systems solve this positioning problem by vertically adjusting the lowermost surface of the pocket holding the folded sheet section. If such a surface is lowered, the folded section resting thereon is also lowered. Similarly, if the lowermost surface is raised, the folded section resting thereon is also raised. What is needed is more precise lap-gripping adjustment system that is independent of the lowermost surface of the pocket.

U.S. Pat. No. 5,911,416 to Klopfenstein describes a sheet material conveying apparatus with a plurality of pockets moveable around a track to accept sheet material from sheet material feeders. These pockets permit, for example, a first outer section of a newspaper to first be fed into the pockets by a first sheet material feeder, and then an inner newspaper section to be inserted between the folds of the first outer newspaper section. The Klopfenstein apparatus uses a lift cam 20 to move a semicircular actuator gear 150 to rotate a drive shaft 110 so as to set a height for pocket feet 90 disposed on racks 80. A pawl and ratchet mechanism prevents the pocket from opening. The sheet material can then be accepted and inserted into the pockets. To deliver the sheet material, a trip cam 22 can release the pawl and ratchet mechanism. Tracks 80 move to a lower position through a biasing spring, so that feet 90 release through operation of a driver cam 130. The sheet material in the pocket can, thus, move out of the pocket from the bottom to be further conveyed or to be stacked. The entirety of Klopfenstein is hereby incorporated by reference.

U.S. Pat. No. 5,251,888 to Eugster purports to describe pockets moveable along an endless path. Each pocket is provided with two vertically adjustable stops 14 mounted displaceably in a pocket carrier 8. A guide member 28 purportedly can be set to vertically adjust the stops 14 as the pockets are moved along the endless path.

Other examples of adjustment devices for the bottom of a pocket can be found in U.S. Pat. No. 3,891,202 to Kircher, U.S. Pat. No. 4,373,710 to Hansen et al., and U.S. Pat. No. 6,311,968 to Linder et al.

These prior art pocket systems do not provide an adjustment device for setting placement of grippers at the top of the pocket or at the gripper location itself.

SUMMARY OF THE INVENTION

It is accordingly an object of the invention to provide an adjustable gripping device for adjustable sheet-receiving pockets that overcomes the hereinafore-mentioned disadvantages of the heretofore-known devices of this general type and that better separates the forward lap from the rearward lap by adjusting grippers in a vertical direction with respect to a pocket so that the forward lap is gripped in the most efficient place.

Commonly assigned U.S. patent application Ser. No. 09/662,277, entitled "SHEET MATERIAL CONVEYING APPARATUS WITH INDIVIDUALLY-ADJUSTABLE POCKETS" filed on Sep. 14, 2000, describes a plurality of manually-adjustable pockets, each having a setting device for adjusting a height of the pocket.

Commonly assigned U.S. patent application Ser. No. 09/702,012, entitled "SHEET MATERIAL CONVEYING APPARATUS WITH HEIGHT-ADJUSTABLE POCKETS" filed on Oct. 30, 2000, describes a plurality of manually adjustable pockets, each having a setting device for adjusting a height of the pocket so as to define a set height.

Commonly assigned U.S. patent application Ser. No. 10/178,645, entitled "ADJUSTABLE GRIPPING DEVICE FOR ADJUSTABLE SHEET-RECEIVING POCKETS AND METHOD FOR ADJUSTING SHEET-RECEIVING POCKETS" and filed concurrently herewith, describes a different gripper adjusting system 70 where each gripper 71 is individually adjustable through a gripper plunger 73 having a plunger body 75 with a nose, a rod 76, and a cam follower 77 attached to the end of rod 76. The nose directly contacts and holds forward lap 61 of a section 6, or holds the entire section 6, 61, 63. Depending on a setting of a vertically adjustable cam 26 the nose moves away from or towards an upper edge of the rearward lap 63.

Commonly assigned U.S. patent application Ser. No. 10/178,642, entitled "LAP SEPARATOR FOR SHEET-RECEIVING POCKETS AND METHOD FOR SEPARATING LAPS IN SHEET-RECEIVING POCKETS" and filed concurrently herewith, describes a lap separator system 70 for extending a window of time for allowing grippers 53, 55 to engage a forward lap 61. The lap separating system 70 includes at least one lap separator 72 moveably disposed on a lap separator carrier system 74, preferably in the form of an endless belt that follows pockets 10, but moves at a different speed. Lap separator 72 contacts a rearward side of upper rear wall 54 and forces it against upper front wall 52, thereby clamping a folded section 6 therebetween. As lap separator 72 is traveling with but faster than pocket 10, it first lets go of upper rear wall 54, then of rearward lap 63, and, finally, of upper front wall 52 by dragging over the uppermost edge of each, similar to a fanning of a deck of cards.

A setting device of some of the commonly assigned applications is manually operated by an operator, who turns a knob gear and sets a lock ring for a desired pocket height. It may be desirable to provide a less time consuming, one-step setting device for each pocket.

Each of these commonly assigned applications is hereby incorporated by reference herein.

With the foregoing and other objects in view, there is provided, in accordance with the invention, an adjustable gripper system for releasably holding at least one sheet against a surface, including a pivotable gripper shaft with a pivot axis and at least one gripper having a gripper body defining a plunger cavity, the gripper body connected to the gripper shaft for pivoting the gripper about the pivot axis, a gripper plunger slidably disposed in the plunger cavity and configured to hold the at least one sheet against the surface, and a cam follower to be actuated by a cam, the cam follower connected to the gripper plunger to displace the gripper plunger along the plunger cavity dependent upon a position of the cam.

In accordance with another feature of the invention, the gripper is a plurality of grippers spaced apart from one another on the gripper shaft.

In accordance with a further feature of the invention, the gripper body is releasably connected to the gripper shaft.

In accordance with an added feature of the invention, the gripper plunger has a nose for holding the sheet against the surface.

In accordance with an additional feature of the invention, the cam follower has a follower to be actuated by the cam and a cam rod connecting the gripper plunger to the follower.

In accordance with yet another feature of the invention, the plunger cavity has a plunger body portion with a given diameter and a cam rod portion having a diameter smaller than the given diameter, the gripper plunger has a plunger body with a body diameter, the cam rod has a cam rod diameter smaller than the body diameter, the plunger body is slidably disposed in the plunger body portion, and the cam rod is slidably disposed in the cam rod portion.

In accordance with yet a further feature of the invention, there is provided a bias device connected to the gripper body and the plunger body, the bias device biasing the plunger body with respect to the gripper body. Preferably, the bias device is a spring.

In accordance with yet an added feature of the invention, the bias device is disposed in the plunger body portion.

In accordance with yet an additional feature of the invention, the gripper body has a wall between the plunger body portion and the cam rod portion and the bias device is disposed between the wall and the plunger body. The bias device can also be disposed around the cam rod. Preferably, the wall is disk-shaped.

In accordance with again another feature of the invention, the cam rod has an end and the follower is a wheel and an axle rotatably connecting the wheel to the end.

With the objects of the invention in view, there is also provided a sheet-collating pocket, including a forward wall having an upper end portion, a rearward wall pivotably connected to the forward wall for moving towards and away from the forward wall, the rearward wall and the forward wall together defining an opening for receiving at least one sheet, and an adjustable gripper system for releasably holding the sheet against the forward wall, the gripper system disposed at the upper end portion and having a pivotable gripper shaft with a pivot axis and at least one gripper having a gripper body defining a plunger cavity, the gripper body connected to the gripper shaft for pivoting the gripper about the pivot axis, a gripper plunger slidably disposed in the plunger cavity and configured to hold the sheet against the forward wall, and a cam follower to be actuated by a cam, the cam follower connected to the gripper plunger to displace the gripper plunger along the plunger cavity dependent upon a position of the cam.

In accordance with again a further feature of the invention, the pocket travels in a given direction and the forward wall is disposed downstream of the rearward wall with respect to the given direction.

In accordance with again an added feature of the invention, the upper end portion is an upper third, an upper fourth, or an upper fifth of the forward wall. Preferably, the forward wall has a top and the gripper system is disposed substantially at the top.

With the objects of the invention in view, in a sheet-collating pocket having a top, a forward wall, and a rearward wall pivotably connected to the forward wall, the rearward and forward walls together defining an opening for receiving at least one sheet from the top, there is also provided an adjustable gripping system for setting placement of grippers at the top of the pocket, the gripping system including a pivotable gripper shaft with a pivot axis and at least one gripper having a gripper body defining a plunger cavity, the gripper body connected to the gripper shaft for pivoting the gripper about the pivot axis, a gripper plunger slidably disposed in the plunger cavity and configured to hold the at least one sheet against the forward wall, and a cam follower to be actuated by a cam, the cam follower connected to the gripper plunger to displace the gripper plunger along the plunger cavity dependent upon a position of the cam.

With the objects of the invention in view, there is also provided a sheet-collating machine, including a conveyor traveling along a transport direction, at least one sheet feeding device disposed at the conveyor for feeding at least one sheet towards the conveyor to a plurality of sheet-collating pockets, and a cam having an adjustment device placing the cam in different positions with respect to the pockets, the cam disposed at the conveyor and selectively contacting each of the pockets as each pocket respectively passes thereby. Each of the pockets is connected to the conveyor, receives the sheet from the sheet feeding device, and transports the sheet along at least a portion of the conveyor in the transport direction. Each of the pockets has a forward wall with an upper end portion, a rearward wall pivotably connected to the forward wall, and an adjustable gripper system for releasably holding the at least one sheet against the forward wall. The rearward wall and the forward wall together define an opening for receiving the sheet. The gripper system is disposed at the upper end portion and has a pivotable gripper shaft with a pivot axis and at least one gripper having a gripper body defining a plunger cavity, the gripper body connected to the gripper shaft for pivoting the gripper about the pivot axis, a gripper plunger slidably disposed in the plunger cavity and configured to hold the at least one sheet against the forward wall, and a cam follower actuated by the cam, the cam follower connected to the gripper plunger to displace the gripper plunger along the plunger cavity dependent upon a position of the cam.

In accordance with again an additional feature of the invention, the conveyor is an endless conveyor.

In accordance with still another feature of the invention, the sheet feeding device is disposed above the conveyor and the pockets.

In accordance with a concomitant feature of the invention, the forward wall is disposed downstream of the rearward wall with respect to the transport direction.

The present invention permits the grippers to be set to a set height while moving and to operate for a relevant distance at the set height. To change a gripper height, a movable setting cam is set for a new height and may also include a lock engagement device. The present invention provides a simple device for resetting gripper height and allows for manual re-setting of the gripper height.

"Rod" as defined herein can be any elongated structure. "Slide gear" as defined herein specifically includes any type of slidable interlocking structure, and may include a gear with an exterior star gearing, a single key or tooth exterior structure, or any other structure with which a ring gear may be fixed rotationally and with which a lock ring may be selectively fixed or free to rotate, include one having a ball-detent mechanism.

Other features that are considered as characteristic for the invention are set forth in the appended claims.

Although the invention is illustrated and described herein as embodied in an adjustable gripping device for adjustable sheet-receiving pockets, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
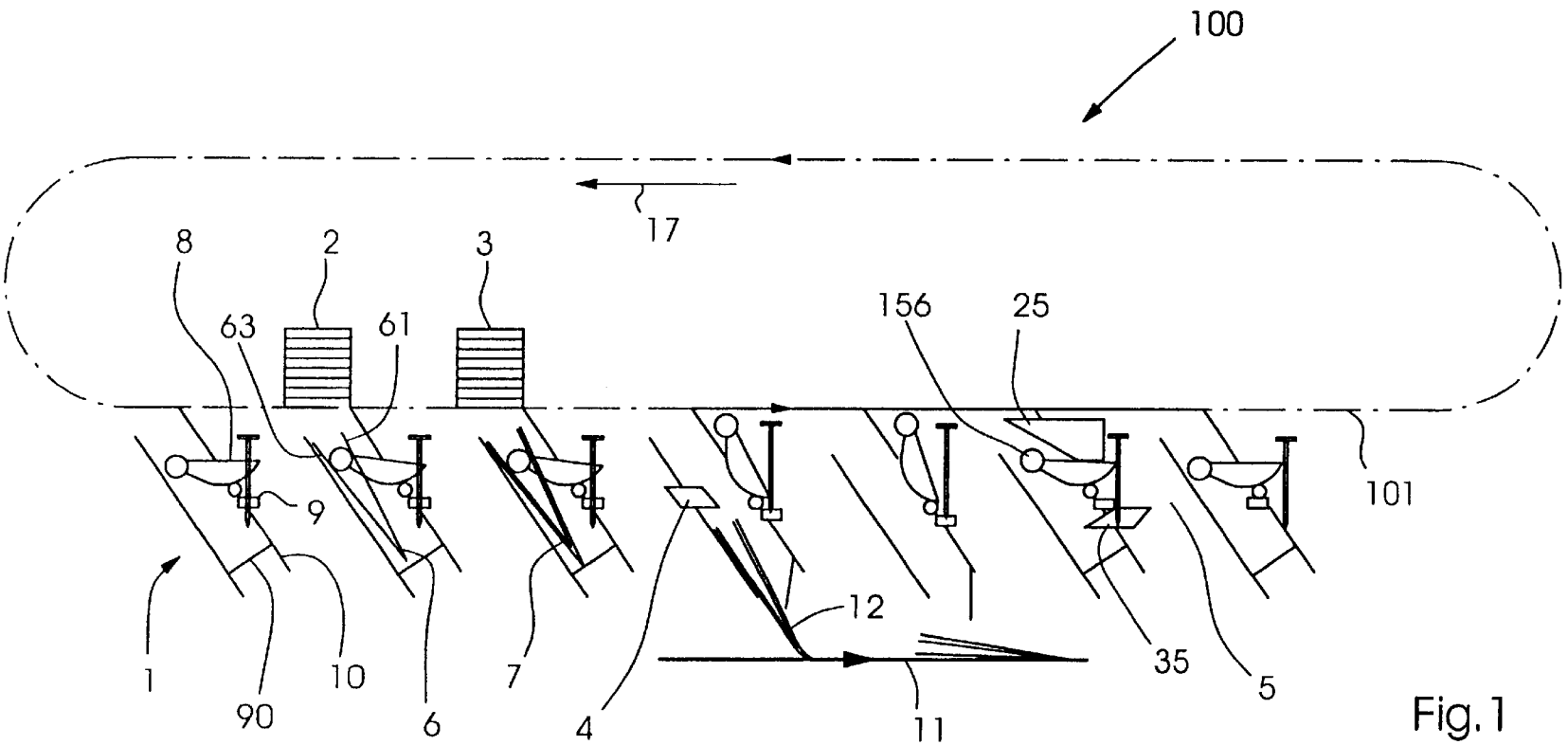
FIG. 1 is a diagrammatic perspective view of a sheet material conveying apparatus according to the invention.

Referring now to the figures of the drawings in detail and first, particularly to FIG. 1 thereof, there is shown a diagrammatic representation of a sheet material conveying apparatus 100 having an endless track 101 for transporting a plurality of pockets 10 in transport direction 17. Each pocket 10 includes moveable fingers 90 for defining a pocket height, an individual height setting mechanism 8, and a releasable lock mechanism 9 for height setting mechanism 8.

At a setting area 1, each pocket 10 can be set manually by setting mechanism 8 to move fingers 90 to at least one of two desired heights, for example, a setting for receiving 10½-inch folded products. Pockets 10 are stationary during setting, and the setting can occur outside setting area 1 as well, for example, by an operator moving about track 101.

Alternatively, pockets 10 can be moved to setting area 1, the apparatus can be stopped, and each pocket can be set. An automated robot for interacting with setting mechanism 8 also could be located at setting area 1 to move each pocket 10 to the proper height, as a pocket 10 is moved to and stopped at setting area 1.

After a pocket is set to a desired height, setting mechanism 8 is then locked in place by lock mechanism 9 so that the pocket height is set. After all the pockets 10 are set, the pockets are moved to pass beneath a first sheet material feed station 2 where, for example, a folded cover section 6 of a newspaper or other printed product, also referred to as a jacket, is delivered into pocket 10. At a second and optional sheet material feed station 3, a second section 7 may be inserted between forward and rear portions of cover section 6 to form a final printed product 12. This process can be repeated for any number of feed stations 2, 3 to create a final product 12 having many nested sections 6, 7.

After receiving sections 6, 7, pockets 10 can then pass a release station 4, which releases lock mechanism 9. Setting mechanism 8, which is, preferably, spring-loaded, then releases fingers 90 so that the bottom of pocket 10 opens, and finished products 12 are delivered, for example, to a conveyor belt 11.

As pockets 10 continue past release station 4, pockets 10 pass through a reset station 5, which can include a movable incline reset ramp 25 for interacting with a reset cam follower 156 (see FIG. 3) of setting mechanism 8 and a lock engagement device 35 for locking lock mechanism 9. Pockets 10, which are preferably all set to a common height, are then reset to the common height by reset ramp 25, and locked into place by lock engagement device 35 engaging lock mechanism 9.

Figure 2A:
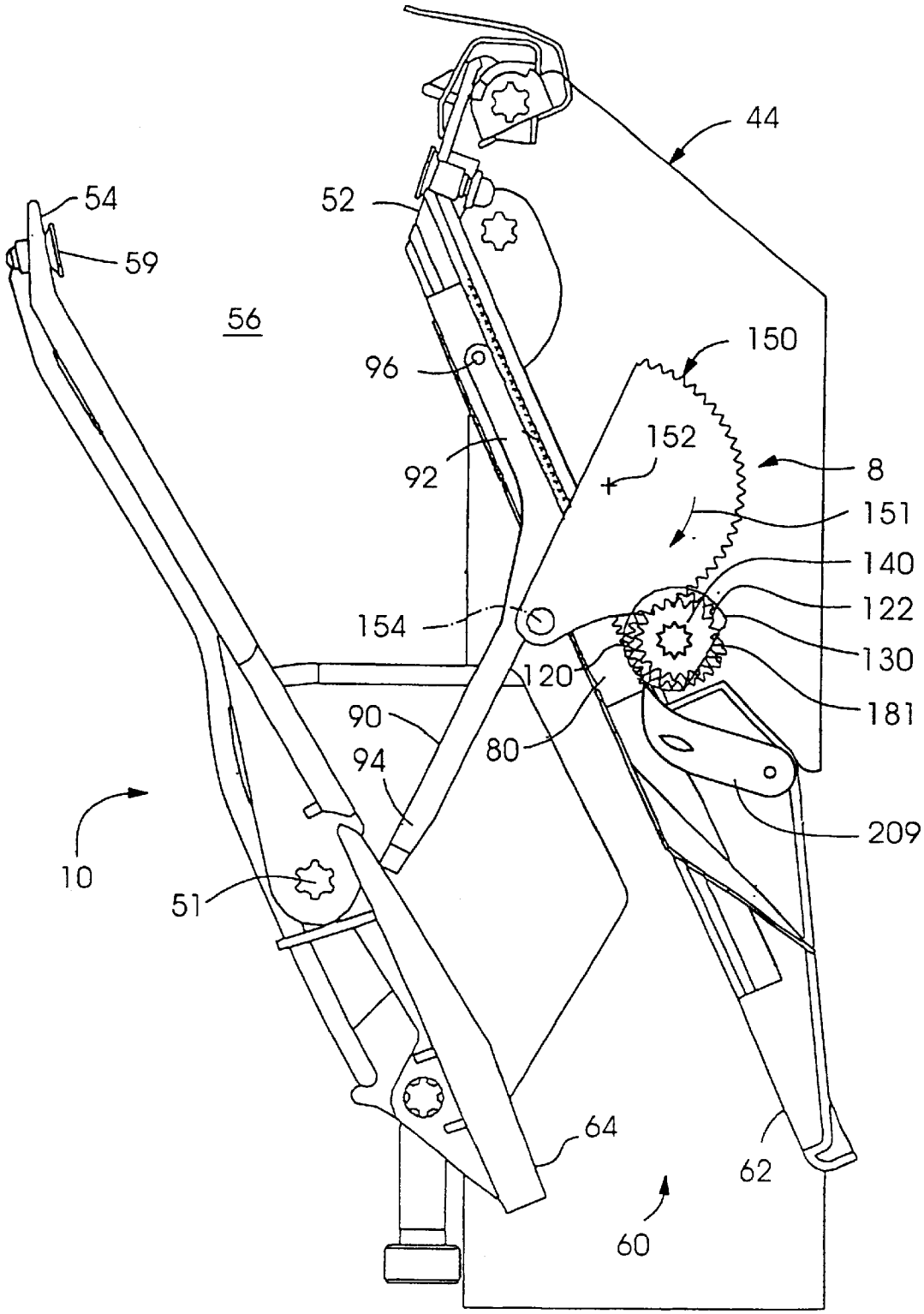
FIG. 2A is a side view of a pocket according to the invention with certain elements omitted for clarity.
Figure 3:
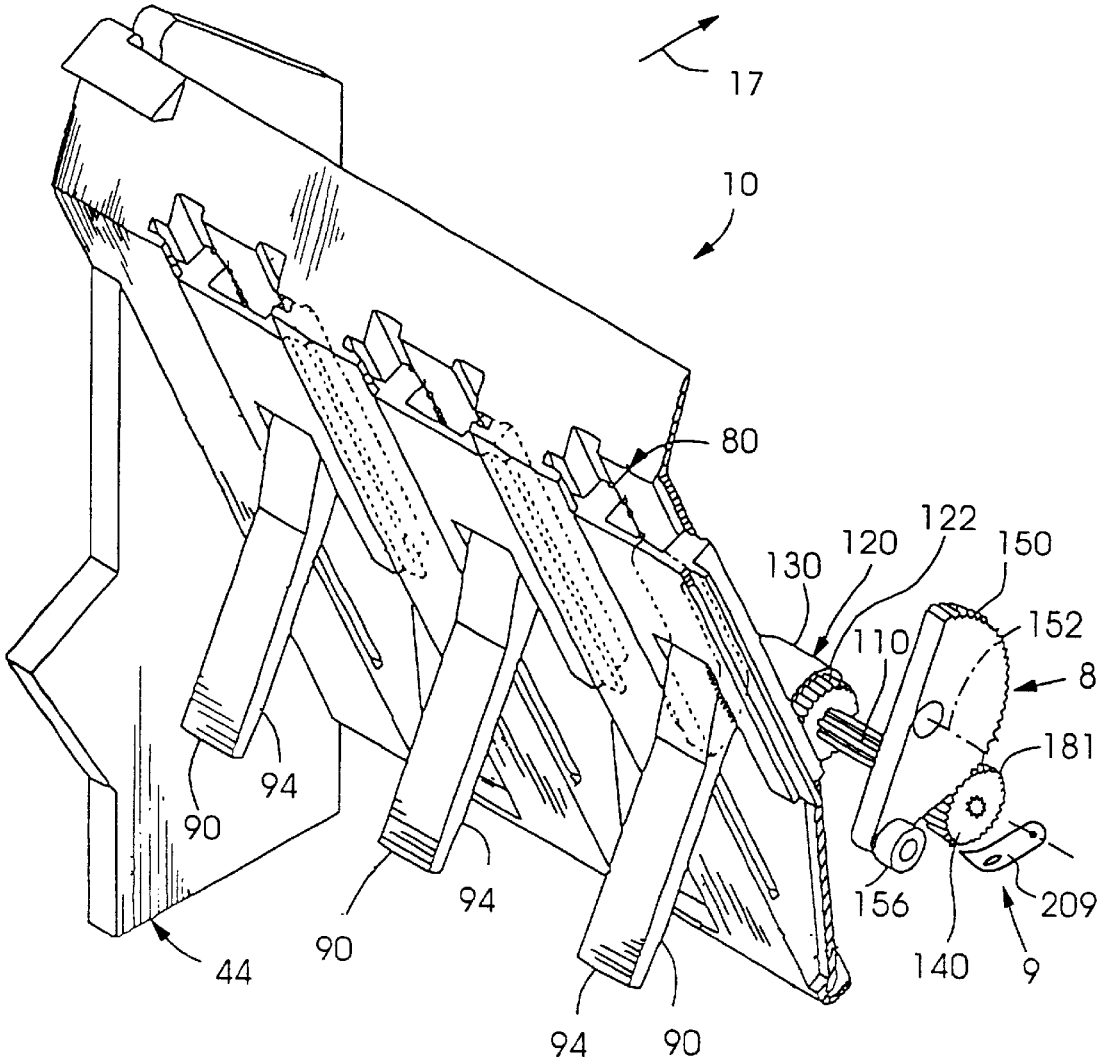
FIG. 3 is a fragmentary perspective view of the pocket of FIG. 2A with certain elements omitted for clarity.
Figure 4:
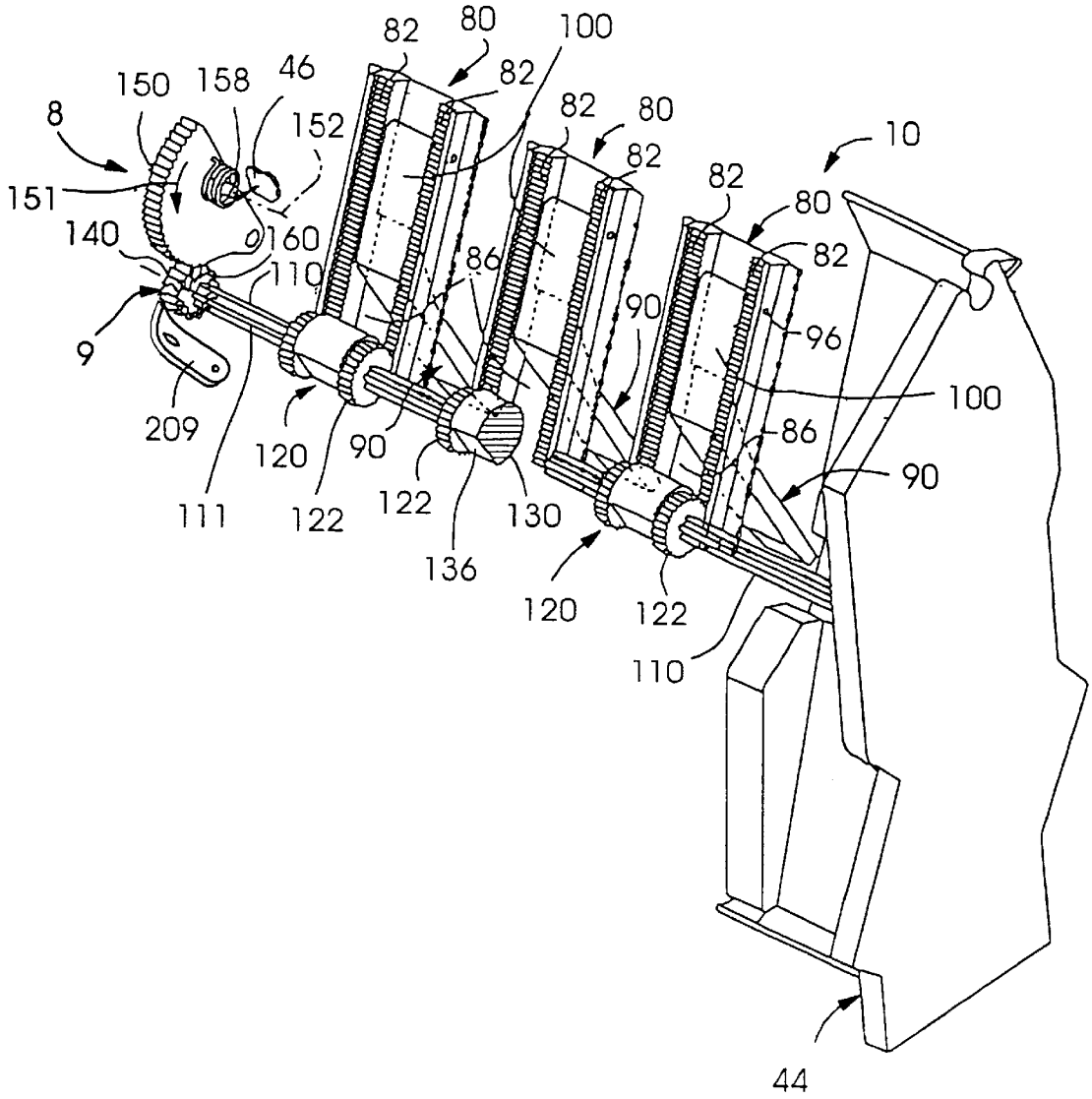
FIG. 4 is a different, fragmentary perspective view of the pocket of FIG. 3.

FIGS. 2A, 3, and 4 show more details of pocket 10.

Pocket 10 has an upper rear wall 54 and an upper front wall 52, in between which is an opening 56 for accepting sheet material, for example, cover section 6. Pocket 10 also has a side wall 44. Pocket 10 also may have a lower rear wall 64 and a lower front wall 62.

Figure 2B:
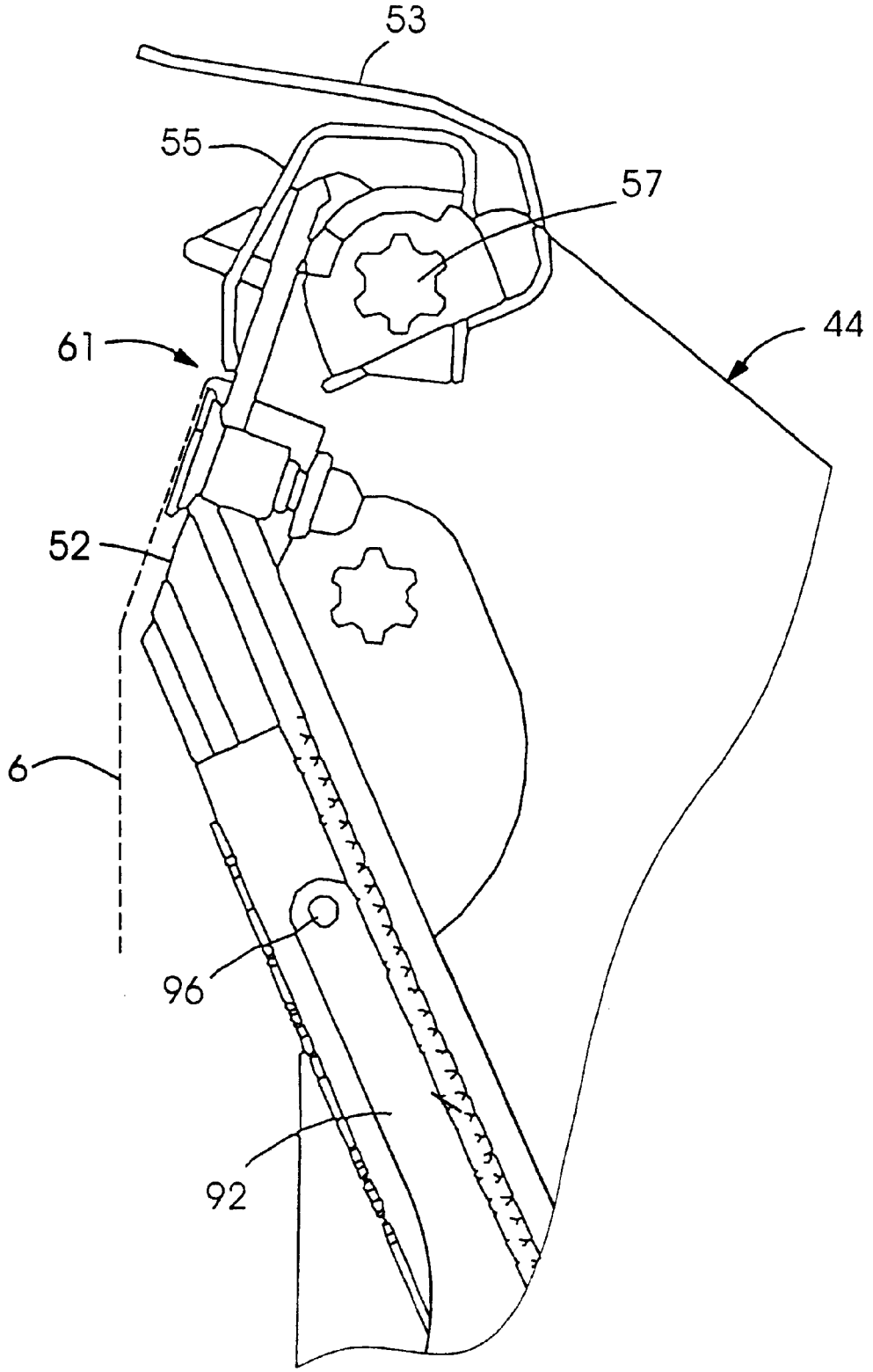
FIG. 2B is a side view of an enlarged detail of a gripper of the pocket of FIG. 2A.

FIG. 2B is an enlarged view of the upper portion of pocket 10 illustrated in FIG. 2A. FIG. 2B shows the area where forward lap 61 of a cover section 6 is held. To hold cover section 6 in place, a set of grippers 53, 55 are located at the top of upper front wall 52. Grippers 53, 55 are shown coaxially disposed on a single shaft 57, albeit in different rotational positions. However, alternatively, different sets of grippers can be disposed on different shafts, each being independently controlled. For example, grippers of one set can be longer than grippers of another set. Also, grippers 53, 55 are shown at the top of upper front wall 52. However, grippers 53, 55 can be located at the upper third, fourth, or fifth of upper front wall 52, depending upon the distance between the top of section 6 and a top of upper front wall 52.

A non-illustrated control device pivots the shaft 57 holding the grippers 53, 55 between an engaged position and a disengaged position. In FIG. 2B, one gripper 53 is shown in the disengaged position and the other gripper 55 is shown in the engaged position. In the engaged position, the gripper 55 holds the forward lap 61 of the cover section 6 so that it is fixed with respect to the upper front wall 52. A cover section 6 being so held is shown diagrammatically in FIG. 2B with a dashed line. See also FIGS. 8A and 8B.

When the cover section 6 is first deposited in the opening 56, the bottom (lowermost) edge of the cover section 6 rests at the junction between the fingers 90 and the upper rear wall 54. In the open position of the pocket 10 shown in FIG. 2A, gravity causes the cover section 6 to rest entirely against the upper rear wall 54. To grip the cover section 6 with the grippers 53, 55, the upper rear wall 54 is pivoted about axis 51 to contact the upper front wall 52. Alternatively and/or additionally, the entire rear wall 54, 64 can be displaced towards the front wall 52, 62. When the cover section 6 rests against the upper front wall 52, the grippers 53, 55 can be rotated into the engaged position and hold the cover section 6 in place against the upper front wall 52. If the grippers 53, 55 are adjusted so that they extend no further than the top edge of the rearward lap 63 of the cover section 6 (see FIGS. 8A and 8B), then the grippers 53, 55 only grip the forward lap 61 of the cover section 6. After engaging the forward lap 61, when the upper rear wall 54 is moved back to the position shown in FIG. 2A, the forward lap 61 is held against the upper front wall 52 and gravity carries the rearward lap 63 of the cover section 6 along with the upper rear wall 54, thus creating an opening between the forward lap 61 and rearward lap 63 for receiving another section 7 therein, for example, from the second sheet material feed station 3.

Slidable with respect to upper front wall 52 is a rack 80, on which the fingers 90 are supported. The fingers 90 are supported on the rack 80 by a pivot 96 attached to a first section 92 of the finger 90. A second section 94 of the finger 90 can define a pocket bottom when the fingers 90 are in a closed position (as illustrated in FIG. 2A). As most clearly shown in FIG. 4, rack 80 includes teeth 82 that interact with a gear 122 of a pinion 120 (FIGS. 3 and 4), which also includes a release cam 130. Pinions 120 are located on a shaft 110 rotatably supported in wall 44 and wall 46 (only partially shown in FIG. 4).

At the wall 46, an end 111 of shaft 110 passes through a setting ring gear 140, of which only a first part is shown in FIG. 3. Ring gear 140 has an interior surface that ensures rotation of ring gear 140 in a fixed relationship with a slide gear 180 (FIG. 5) that is in a fixed rotational relationship with shaft 110. Slide gear 180, however, can slide axially with respect to shaft 110 for selective interlocking with the lock ring 160 (interior to gear 140 and visible in FIG. 6) that forms part of lock mechanism 9. Lock mechanism 9 also includes a pawl 209 for interacting with a single ratchet 164 on the exterior of ring 160. Ring gear 140 is shown in FIGS. 2A, 3, and 4 only in part, with a second outer gear section 182 (FIGS. 5 and 6) for interacting with a non-illustrated setting rod. The details of slide gear 180 and its interaction with ring gear 140 and lock ring 160 will be described in more detail with respect to FIGS. 5 and 6.

FIG. 3 shows how fingers 90 extend through the front wall. Release cam 130 can interact with a release surface 100 (FIG. 4) of finger 90 located in an opening 86 between teeth 82 when fingers 90 are fully lowered, so that the fingers 90 rotate away from the rear wall 54, 64 and release any products in the pocket 10. Release of the fingers 90 is similar to the release of the feet in U.S. Pat. No. 5,911,416 to Klopfenstein, which has been incorporated herein by reference.

FIG. 2A shows ring gear 140 interacting with a semicircular setting gear 150. On one side of semicircular gear 150 is a reset cam follower 156 held rotationally at an axis 154. The setting gear 150 pivots about an axis 152.

As shown in FIG. 4, the semicircular gear 150 is attached to a spring 158 to spring-load the gear 150 in a direction 151, as also shown in FIG. 2A.

Figure 5:
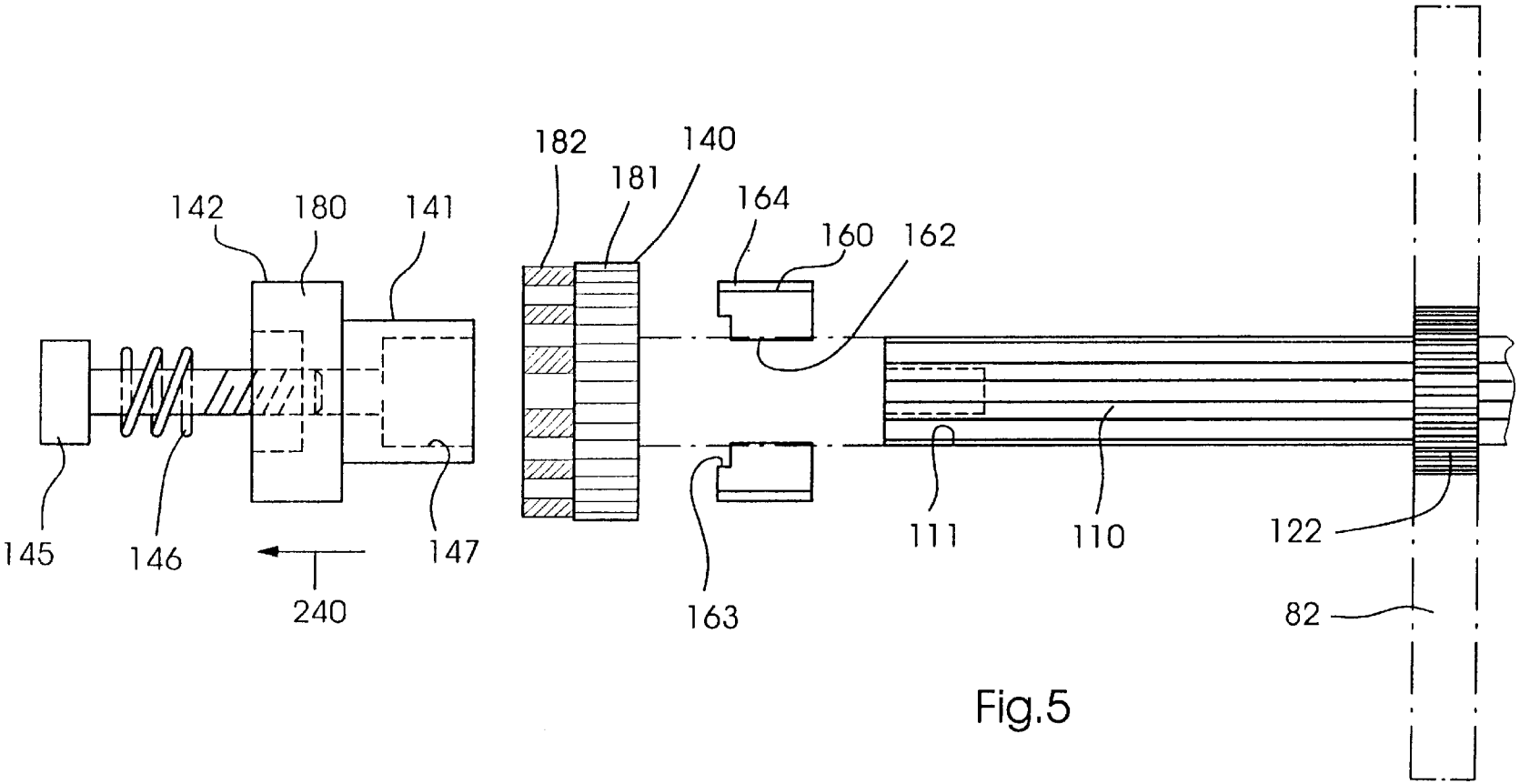
FIG. 5 is a fragmentary, partially exploded, cross-sectional view of a setting device for setting a finger height according to the invention.
Figure 6:
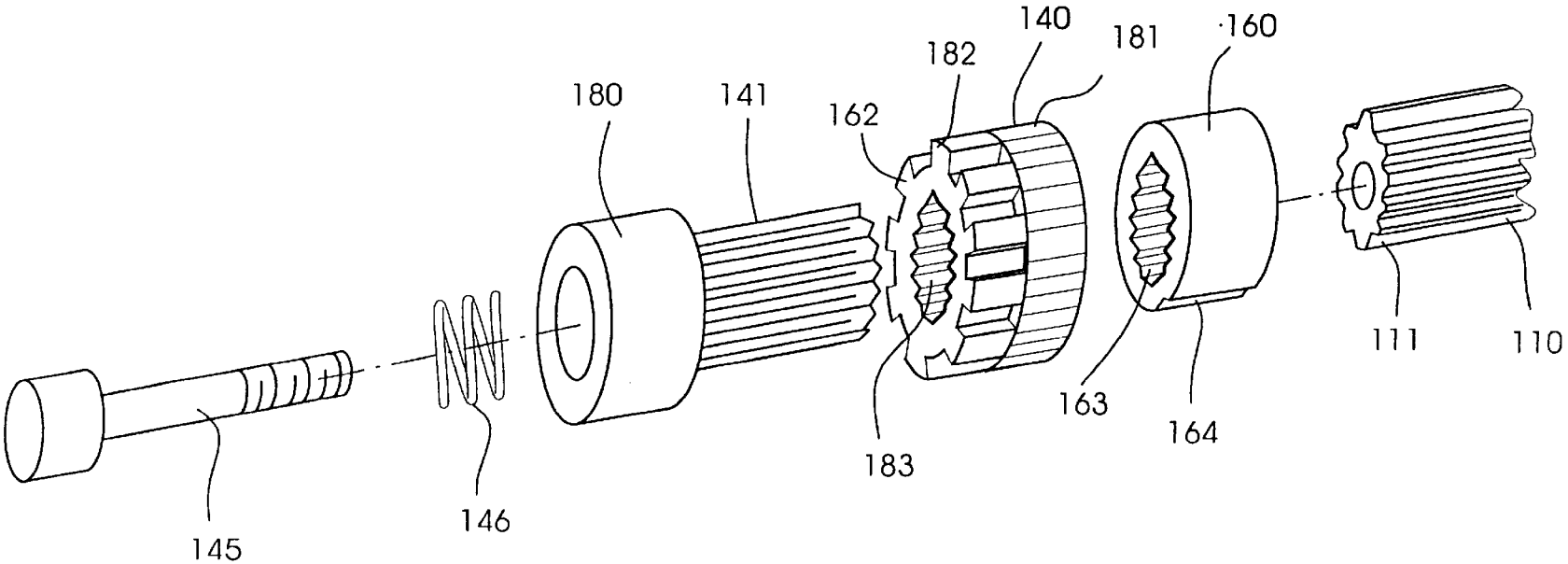
FIG. 6 is a fragmentary, exploded, perspective view of the setting device of FIG. 5.

FIG. 5 shows an exploded view of certain details of the setting mechanism. End 111 of shaft 110 fits, passing through interior holes in ring gear 140 and lock ring 160, into an interiorly toothed hole 147 of slide gear 180. End 111 is fixed to a screw 145 that abuts slide gear 180 through a spring 146. Thus, slide gear 180 can be moved against the force of spring 146 in the direction of arrow 240 so as to slide axially with respect to shaft 110, however always remaining rotationally fixed with the shaft 110.

Slide gear 180 has exterior star gearing 141 that matches interior star gearing 183 of ring gear 140. Slide gear 180 and ring gear 140 thus rotate together at all times. Interior to slide gear 180 and ring gear 140 is lock ring 160, which selectively engages, through an interior star gear 163, exterior star gearing 141 of slide gear 180 when slide gear 180 is not moved axially against the spring force of spring 146.

When moved axially against the spring force in direction 240 (see FIG. 5), slide gear 180 releases from lock ring 160, which then is held only by pawl 209 but is freely rotatable with respect to shaft 110 due to a smooth inner surface section 162 that rests on shaft 110.

Slide gear 180 has a raised portion 142 for interacting with a disengaging device of a non-illustrated setting rod to permit the slide gear 180 to be moved against the spring force of spring 146.

Ring gear 140 has external gear teeth 181 for interacting with semicircular gear 150 (FIG. 2A), as well as external gear teeth of the second outer gear section 182 for interacting with the setting rod.

Figure 7:
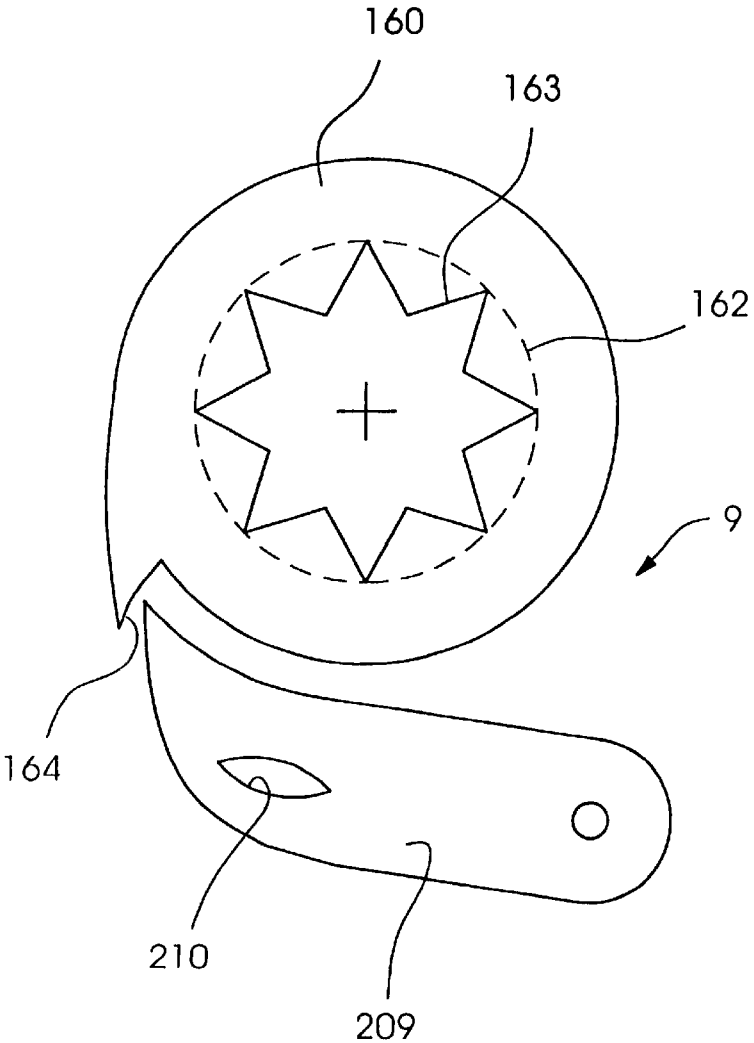
FIG. 7 is an enlarged side view of a detail of the setting device of FIG. 5.

Lock ring 160 has a single ratchet 164 on an external surface, which interacts with pawl 209, as shown in FIG. 7. An extension 210 extends outwardly from pawl 209, for permitting pawl 209 to move between an upward and a downward position. The pawl 209 may be spring-loaded to favor one position, or to click into both positions.

As stated above, after a pocket 10 is set to a desired height, the setting mechanism 8 is then locked in place by the lock mechanism 9 so that the pocket height is set. After all the pockets 10 are set, the pockets 10 are moved to pass beneath at least one sheet material feed station 2, 3 where, for example, sections 6, 7 of a newspaper or other printed product are delivered into the pocket 10.

Once the pocket 10 is set to a desired height, it typically cannot be adjusted to account for variations in the size of the sections 6, 7 being placed therein. Prior art devices have been created to adjust for such variations by only adjusting the level or location of the bottom of the pocket. Thereby, raising or lowering the section 6, 7 placed therein from below. However, no prior art device has used an adjustment of the grippers 53, 55 to compensate for section 6, 7 size variation.

As set forth above, up until the invention, there was a difficulty associated with separating the forward lap 61 of a first section 6 from the rearward lap 63 to create a pocket therebetween into which the second section 7 can be inserted or nested.

The invention adds a new adjustment mechanism to the grippers 53, 55.

Figures 8A, 8B:
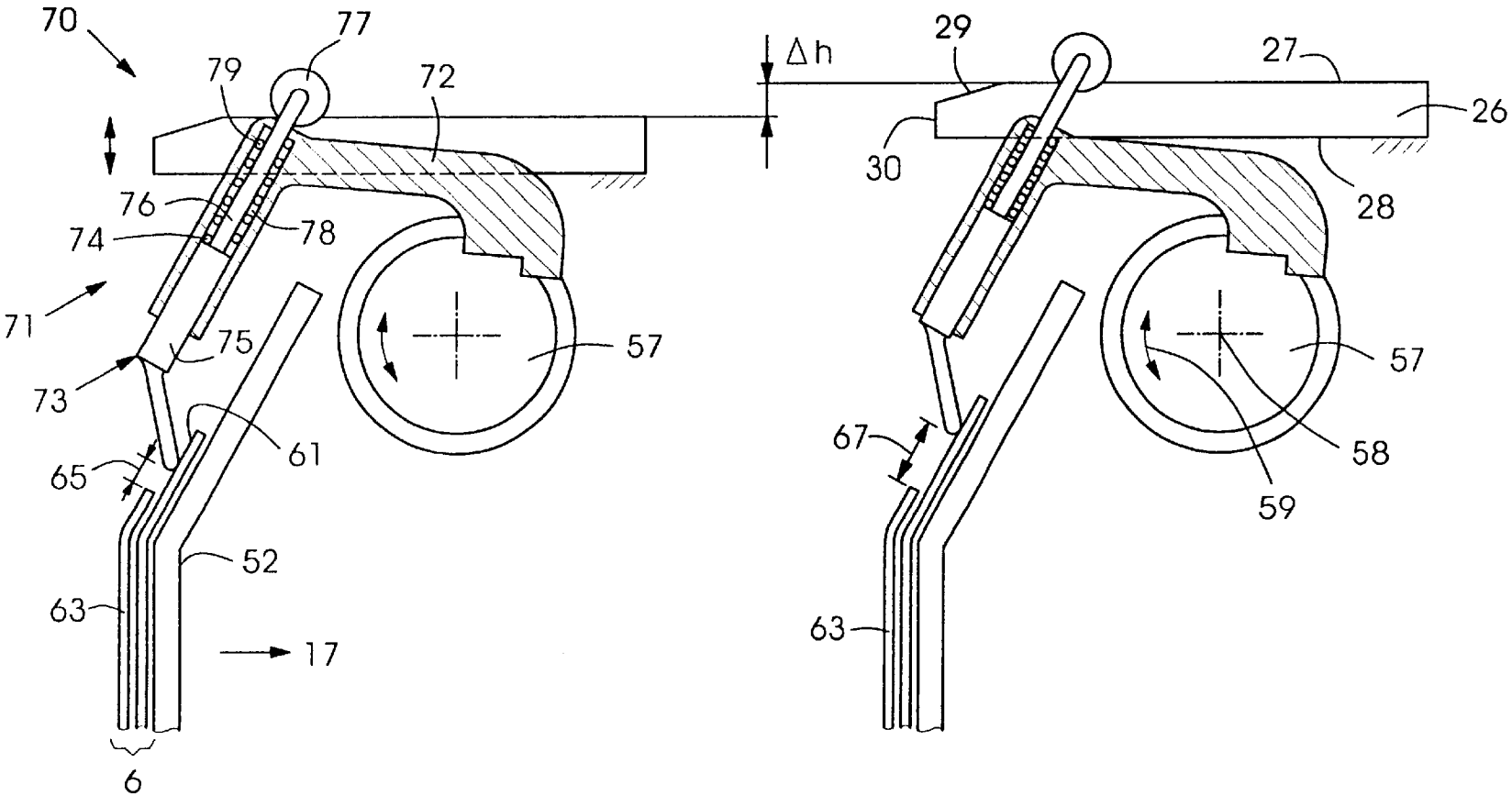
FIG. 8A is a diagrammatic, partially cross-sectional, side view of a gripper system according to the invention.
FIG. 8B is a diagrammatic, partially cross-sectional, side view of the gripper system of FIG. 8A in a different cam-adjusted position.

FIGS. 8A and 8B diagrammatically illustrate a gripper adjusting system 70. A single gripper 71 is depicted in FIGS. 8A and 8B for the sake of clarity. Nonetheless, system 70 can be expanded to many or all of the grippers used to grip forward lap 61 in a pocket 10. Gripper 71 has a gripper body 72, a gripper plunger 73, and a reset spring 74. Gripper plunger 73 includes a plunger body 75 with a nose, a rod 76, and a cam follower 77. The nose directly contacts and holds forward lap 61 of a section 6, or holds the entire section 6, 61, 63. Gripper body 72 is attached, preferably, fixedly but adjustably, to gripper shaft 57, which is diagrammatically illustrated in FIGS. 2A and 2B. Thus, when shaft 57 rotates about its axis 58 in either rotation direction 59, gripper 71 is rotated as well, and the nose of plunger body 75 either lifts away from upper front wall 52 to let go of or make room to grasp forward lap 61 or moves towards upper front wall 52 to grasp forward lap 61 of section 6.

Gripper body 72 defines a cavity 78 having forward and rearward openings (with respect to an insertion direction of gripper plunger 73). The larger forward opening is sized to slidably fit the outer circumference of plunger body 75. The smaller rearward opening is sized to slidably fit the outer circumference of rod 76. Cavity 77 also has a rear, disk-shaped wall 79 to hold the rearmost end of reset spring 74. Thus, while reset spring 74 can slidably fit into cavity 78, it can only be inserted until it hits rear wall 79. Alternatively, reset spring 74 can be integral with rear wall 79.

Rod 76 of gripper plunger 73 is inserted into cavity 78. Rod 76 has an outer diameter that is smaller than an inner diameter of reset spring 74 and, therefore, rod 76 passes through reset spring 74 unobstructed. Rod 76 also passes rear wall 79 and exits the second smaller opening of cavity 78 to project out of the top (with respect to the views of FIGS. 8A and 8B) of gripper body 72. A cam follower 77 is attached to the end of rod 76.

The other, forward, end of reset spring 74 contacts a rearward disk-shaped wall of plunger body 75. As such, when plunger body 75 enters cavity 78, reset spring 74 is compressed. In such an embodiment, plunger body 75 is biased to travel out of cavity 78.

The rod 76 and cam follower 77 combination and connection can take various forms. For example, rod 76 can have an axle hole (extending into the plane of the views of FIGS. 8A and 8B) for receiving an axle or shaft that is then attached to a wheel-shaped cam follower 77. Other equivalent attachment embodiments can be used as well.

FIGS. 8A and 8B illustrate how gripper system 70 works. A vertically adjustable gripper bite adjustment cam 26 is placed in the path of pockets 10 as they travel in transport direction 17. Adjustment cam 26 is placed in a position similar to incline reset ramp 25, in that, a portion of pocket 10 must contact adjustment cam 26 as the portion passes thereby. Before any pocket 10 reaches adjustment cam 26, the bias of reset spring 74 pushes plunger body 75 out of the cavity 78, for example, until the connection of rod 76 and cam follower 77 abuts the upper surface of gripper body 72 or to the fullest extent of an uncompressed reset spring 74, whichever is smaller. In such a position, the nose of plunger body 75 is disposed at a given first distance 65 from the end of rearward lap 63. Such an embodiment is illustrated in FIG. 8A.

Adjustment cam 26 can be set to any vertical distance with respect to gripper body 72.

In the view of FIG. 8A, adjustment cam 26 is set to a lowermost activating position. In such a position, when pocket 10, including gripper system 70, passes by adjustment cam 26, cam follower 77 merely rolls along the upper surface 27 of adjustment cam 26 and does not contact ramp 29. Such a position is called a lowermost activating position because adjustment cam 26 has no affect upon cam follower 77 if adjustment cam 26 is lowered any more than that shown in FIG. 8A. In the lowermost activating position, the nose of plunger body 75 is at a distance 65 from the uppermost edge of rearward lap 63.

In the view of FIG. 813, adjustment cam 26 is set to a position $\Delta h$ higher than the lowermost activating position. In such a raised position, when pocket 10, including gripper system 70, passes by adjustment cam 26, cam follower 77 first contacts ramp 29 and then rolls up and off ramp 29 onto upper surface 27 of adjustment cam 26. This raised position of adjustment cam 26 has a specific affect upon cam follower 77—cam follower 77, attached to rod 76, pulls rod 76 and, therefore, plunger body 75 further into cavity 78 of gripper body 72. As such, the nose of plunger body 75 is raised vertically along the surface of upper front wall 52 to a distance 67 away from the uppermost edge of the rearward lap 63.

In the lowermost activating position of FIG. 8A, the nose of plunger body 75 is shown at a distance 65 from the uppermost edge of rearward lap 63. However, it is possible, due to a variation in size of rearward lap 63, that the nose of plunger body 75 actually contacts rearward lap 63 and prevents rearward lap 63 from falling away from forward lap 61 to create the pocket for receiving an inserted section 7. In such a situation, the printing press operator can use the invention and prevent this undesired condition by raising adjustment cam 26 such that the nose of plunger body 75 no longer contacts rearward lap 63. Therefore, the invention allows an operator to raise a gripper system 70 of each of pocket 10 without having to manually adjust each gripper 71 of each pocket 10.

The gripper system 70 shown is a linear raising system. In other words, if adjustment cam 26 is raised by $\Delta h$, then plunger body 75 will be pulled into cavity 78 along a distance equal to Δh. Thus, the difference between 65 and 67 is Δh. Gripper system 70 does not have to be a linear raising system, however. It is envisioned to have, if desired, a more complex lever system such that a small raising of the adjustment cam 26 results in a correspondingly larger or smaller raising of the plunger body 75.

Ramp 29 of adjustment cam 26 is depicted as being relatively small and shallow. Of course, ramp 29 can have any length or be at any angle greater than 0 degrees and less than 90 degrees. However, preferably, the length of ramp 29 is at least equal to a radius of the cam follower 77. Also preferable is for the ramp angle to be between 30 and 60 degrees, in particular, to be between 30 and 45 degrees. Adjustment cam 26 is also shown in FIGS. 8A and 8B with a flat front surface 30. In alternative embodiments, the forward-most end of the ramp 29 can be even lower than the illustration of FIGS. 8A and 8B. Preferably, the forward-most end of ramp 29 is approximately level with lower surface 28 of adjustment cam 26 and, where cam follower 77 is wheel-shaped, the forward-most portion 30 of adjustment cam 26 is rounded to permit smooth contact between ramp 29 and cam follower 77.

Vertical movement of the adjustment cam 26, therefore, determines how far gripper plunger 73 is pulled into cavity 78, thus, pulling the nose of plunger body 75 upward along front upper wall 52 and upward along section 6, preferably along forward lap 61.

Vertical movement of adjustment cam 26 can be effected by any device that can raise or lower rod 76.

In the embodiment shown, the bottom of cam follower 77 contacts upper surface 27 of adjustment cam 26. Alternatively, the top of cam follower 77 can contact lower surface 28 of adjustment cam 26. The above-noted example including an axle hole and wheel-shaped cam follower 77 can be used both for contacting upper surface 27 and bottom surface 28 of adjustment cam 27. But, an embodiment can be made so that cam follower 77 only contacts lower surface 28. For example, rod 76 can have a groove with a width and cam follower 77 can be a wheel rotatably disposed in such a groove, the wheel 77 having a width less than the groove width. Wheel 77 can be attached to rod 76 with an axle and cotter pin assembly, for example. In such an embodiment, the reset spring 74 could be positioned not to bias the gripper plunger away from the cam follower 77, but, instead, to bias the gripper plunger 73 in the direction of the cam follower 77. Alternatively, the reset spring 74 could have an adjustment device that limits a bias thereof.

The invention better separates the forward lap from the rearward lap by adjusting grippers in a vertical direction with respect to a pocket so that the forward lap is gripped in the most efficient place.

I claim:

1. An adjustable gripper system for releasably holding at least one sheet against a surface, comprising:

a pivotable gripper shaft with a pivot axis; and at least one gripper having:

a gripper body defining a plunger cavity, said gripper body connected to said gripper shaft for pivoting said gripper about said pivot axis;

a gripper plunger slidably disposed in said plunger cavity and configured to hold the at least one sheet against the surface; and a cam follower to be actuated by a cam, said cam follower connected to said gripper plunger to displace said gripper plunger along said plunger cavity dependent upon a position of the cam.

2. The gripper system according to claim 1, wherein said at least one gripper is a plurality of grippers spaced apart from one another on said gripper shaft.

3. The gripper system according to claim 1, wherein said gripper body is releasably connected to said gripper shaft.

4. The gripper system according to claim 1, wherein said gripper plunger has a nose for holding the at least one sheet against the surface.

5. The gripper system according to claim 1, wherein said cam follower has:

a follower to be actuated by the cam; and a cam rod connecting said gripper plunger to said follower.

6. The gripper system according to claim 5, wherein:

said plunger cavity has:

a plunger body portion with a given diameter; and a cam rod portion having a diameter smaller than said given diameter;

said gripper plunger has a plunger body with a body diameter;

said cam rod has a cam rod diameter smaller than said body diameter;

said plunger body is slidably disposed in said plunger body portion; and said cam rod is slidably disposed in said cam rod portion.

7. The gripper system according to claim 6, including a bias device connected to said gripper body and said plunger body, said bias device adapted to bias said plunger body with respect to said gripper body.

8. The gripper system according to claim 7, wherein said bias device is disposed in said plunger body portion.

9. The gripper system according to claim 8, wherein:

said gripper body has a wall between said plunger body portion and said cam rod portion; and said bias device is disposed between said wall and said plunger body.

10. The gripper system according to claim 8, wherein:

said gripper body has a wall between said plunger body portion and said cam rod portion; and said bias device is disposed:

between said wall and said plunger body; and around said cam rod.

11. The gripper system according to claim 8, wherein said wall is disk-shaped.

12. The gripper system according to claim 7, wherein said bias device is a spring.

13. The gripper system according to claim 5, wherein:

said cam rod has an end; and said follower is a wheel and an axle rotatably connecting said wheel to said end.

14. A sheet-collating pocket, comprising:

a forward wall having an upper end portion;

a rearward wall pivotally connected to said forward wall for moving towards and away from said forward wall, said rearward wall and said forward wall together defining an opening for receiving at least one sheet; and an adjustable gripper system for releasably holding the at least one sheet against said forward wall, said gripper system disposed at said upper end portion and having:

a pivotable gripper shaft with a pivot axis; and at least one gripper having:

a gripper body defining a plunger cavity, said gripper body connected to said gripper shaft for pivoting said gripper about said pivot axis;

a gripper plunger slidably disposed in said plunger cavity and configured to hold the at least one sheet against said forward wall; and a cam follower to be actuated by a cam, said cam follower connected to said gripper plunger to displace said gripper plunger along said plunger cavity dependent upon a position of the cam.

15. The pocket according to claim 14, wherein:

the pocket travels in a given direction; and said forward wall is disposed downstream of said rearward wall with respect to said given direction.

16. The pocket according to claim 14, wherein said upper end portion is an upper third of said forward wall.

17. The pocket according to claim 14, wherein said upper end portion is an upper fourth of said forward wall.

18. The pocket according to claim 14, wherein said upper end portion is an upper fifth of said forward wall.

19. The pocket according to claim 14, wherein said forward wall has a top and said gripper system is disposed substantially at said top.

20. In a sheet-collating pocket having a top, a forward wall, and a rearward wall pivotally connected to said forward wall, the rearward and forward walls together defining an opening for receiving at least one sheet from the top, an adjustable gripping system for setting placement of grippers at the top of the pocket, the gripping system comprising:

a pivotable gripper shaft with a pivot axis; and at least one gripper having:

a gripper body defining a plunger cavity, said gripper body connected to said gripper shaft for pivoting said gripper about said pivot axis;

a gripper plunger slidably disposed in said plunger cavity and configured to hold the at least one sheet against the forward wall; and a cam follower to be actuated by a cam, said cam follower connected to said gripper plunger to displace said gripper plunger along said plunger cavity dependent upon a position of the cam.

21. A sheet-collating machine, comprising:

a conveyor adapted to travel along a transport direction;

at least one sheet feeding device disposed at said conveyor for feeding at least one sheet towards said conveyor;

a plurality of sheet-collating pockets, each of said pockets:

connected to said conveyor;

adapted to receive the at least one sheet from said at least one sheet feeding device; and adapted to transport the at least one sheet along at least a portion of said conveyor in said transport direction;

a cam having an adjustment device adapted to place said cam in different positions with respect to said pockets, said cam disposed at said conveyor and adapted to selectively contact each of said pockets as each pocket respectively passes thereby; and each of said pockets having:

a forward wall with an upper end portion;

a rearward wall pivotally connected to said forward wall, said rearward wall and said forward wall together defining an opening for receiving the at least one sheet; and an adjustable gripper system for releasably holding the at least one sheet against said forward wall, said gripper system disposed at said upper end portion and having:

a pivotable gripper shaft with a pivot axis; and at least one gripper having:

a gripper body defining a plunger cavity, said gripper body connected to said gripper shaft for pivoting said gripper about said pivot axis;

a gripper plunger slidably disposed in said plunger cavity and configured to hold the at least one sheet against said forward wall; and a cam follower actuated by said cam, said cam follower connected to said gripper plunger to displace said gripper plunger along said plunger cavity dependent upon a position of said cam.

22. The sheet-collating machine according to claim 21, wherein said conveyor is an endless conveyor.

23. The sheet-collating machine according to claim 21, wherein said at least one sheet feeding device is disposed above said conveyor and said pockets.

24. The sheet-collating machine according to claim 21, wherein said forward wall is disposed downstream of said rearward wall with respect to said transport direction.

* * * * *